US008442746B2

(12) United States Patent
Ando et al.

(10) Patent No.: US 8,442,746 B2
(45) Date of Patent: May 14, 2013

(54) IGNITION CONTROL DEVICE

(71) Applicant: Imagineering, Inc., Kobe (JP)

(72) Inventors: Hiromitsu Ando, Fukui (JP); Yuji Ikeda, Kobe-shi (JP)

(73) Assignee: Imagineering, Inc., Kobe-shi, Hyogo (JP)

( * ) Notice: Subject to any disclaimer, the term of this patent is extended or adjusted under 35 U.S.C. 154(b) by 0 days.

(21) Appl. No.: 13/627,255

(22) Filed: Sep. 26, 2012

(65) Prior Publication Data

US 2013/0019841 A1 Jan. 24, 2013

Related U.S. Application Data

(63) Continuation of application No. PCT/JP2011/057345, filed on Mar. 25, 2011.

(30) Foreign Application Priority Data

Mar. 26, 2010 (JP) ..... 2010-071446

(51) Int. Cl.
*F02D 41/00* (2006.01)

(52) U.S. Cl.
USPC ... 701/111; 123/406.12; 123/435; 123/143 B; 123/305

(58) Field of Classification Search ..... 123/143 B, 123/406.12, 305, 435; 701/103, 111
See application file for complete search history.

(56) References Cited

U.S. PATENT DOCUMENTS

| | | | | |
|---|---|---|---|---|
| 7,464,688 | B2 * | 12/2008 | Yu et al. | 123/299 |
| 7,493,886 | B2 * | 2/2009 | Blank | 123/256 |
| 2008/0309241 | A1 | 12/2008 | Starikovsky | |
| 2009/0229581 | A1 | 9/2009 | Ikeda | |
| 2010/0258097 | A1 | 10/2010 | Takahashi et al. | |

FOREIGN PATENT DOCUMENTS

| | | | |
|---|---|---|---|
| JP | 2006-242043 | A | 9/2006 |
| JP | 2009-516794 | A | 4/2009 |
| JP | 2010-1865 | A | 1/2010 |
| WO | 2008/035448 | A1 | 3/2008 |

OTHER PUBLICATIONS

International Search Report of PCT/JP2011/057345, mailing date of Aug. 2, 2011.

* cited by examiner

*Primary Examiner* — Hai Huynh
(74) *Attorney, Agent, or Firm* — Westerman, Hattori, Daniels & Adrian, LLP

(57) ABSTRACT

In order to provide an ignition control device 30 which can efficiently control timing of thermal ignition of gaseous mixture in a combustion region 10, the peak estimation part 32, the ignition timing determination part 33, the control timing determination part 34, and the plasma control part 35 control timing of thermal ignition of the gaseous mixture in the combustion region 10 by controlling the pulse generator 36, the electromagnetic wave oscillator 37, the mixer circuit 38, and the spark plug 15 so as to increase the amount of OH radicals in the combustion region 10 during a low-temperature oxidation preparation period that occurs prior to a peak of a heat release rate before the thermal ignition of the gaseous mixture.

7 Claims, 4 Drawing Sheets

IGNITION CONTROL DEVICE

TECHNICAL FIELD

The present invention relates to an ignition control device that controls timing of thermal ignition of a gaseous mixture of hydrocarbon and air.

BACKGROUND ART

As a method of thermally igniting (self-igniting) a gaseous mixture of hydrocarbon and air, various methods are proposed. For example, for an internal combustion engine, ignition methods such as, for example, a premixed charge compression ignition method and an HCCI (Homogeneous Charge Compression Ignition) method are proposed. Starting premix type combustion as a result of pilot injection or the like in a common rail system of diesel engine belongs to such ignition methods.

For example, as for the internal combustion engine, such ignition methods have drawn attention since those ignition methods can achieve higher heat efficiency than the ignition method with spark ignition, and reduce the emission level of nitrogen oxides (NOx). However, those ignition methods have a drawback in that it is difficult to control the timing of thermal ignition.

Conventionally, ignition control devices have been proposed that control timing of thermal ignition of a gaseous mixture in a combustion region. For example, patent document 1 describes an ignition timing control device of a premixed charge compression ignition engine as an ignition control device of this kind. This ignition timing control device generates oxygen radicals by radiating laser beam oscillated by a laser generation device and collected by collecting lens toward the combustion chamber. In the combustion chamber, the oxygen radical is reacted with water vapor to form OH radical (hydroxyl radical), and the OH radical is reacted with hydrocarbon to form alkyl radical. Owing to this ignition timing control device, low-temperature oxidation reaction can be accelerated, and timing of self-ignition can be controlled.

PATENT DOCUMENTS

Patent Document 1: Japanese Unexamined Patent Application, Publication No. 2006-242043

THE DISCLOSURE OF THE INVENTION

Problems to be Solved by the Invention

Meanwhile, the inventor of the present invention has found out that timing of increasing the amount of OH radicals in the combustion region, described further below, plays a crucial role in efficiently controlling timing of thermal ignition of gaseous mixture. The conventional ignition control devices cannot efficiently control the timing of thermal ignition of the gaseous mixture since timing has not been specified at which the amount of OH radicals in the combustion region should be increased during the period up to a time point at which the gaseous mixture is thermally ignited.

The present invention has been conceived in view of the above-described drawbacks, and it is an object of the present invention to provide an ignition control device which can efficiently control timing of thermal ignition of gaseous mixture in a combustion region.

Means for Solving the Problems

In accordance with a first aspect of the present invention, there is provided an ignition control device, comprising: a control unit that controls a radical amount adjusting unit that increases an amount of OH radicals in a combustion region in which gaseous mixture of hydrocarbon and air is combusted, wherein the control unit controls timing of thermal ignition of the gaseous mixture in the combustion region by controlling the radical amount adjusting unit so as to increase the amount of OH radicals in the combustion region during a low-temperature oxidation preparation period that occurs prior to a peak of a heat release rate before the thermal ignition of the gaseous mixture.

According to the first aspect of the present invention, the control unit controls the radical amount adjusting unit that increases an amount of OH radicals in the combustion region. The control unit controls the radical amount adjusting unit so as to increase the amount of OH radicals in the combustion region during the low-temperature oxidation preparation period (also referred to as "LTO" preparation period) (see FIG. 3). The inventor of the present invention has found the fact that "in a case in which the peak of the heat release rate prior to thermal ignition (hereinafter referred to as "peak prior to ignition") occurs in the combustion region, the amount of increase in OH radicals required to change the timing of the thermal ignition of the gaseous mixture is remarkably reduced during the low-temperature oxidation preparation period before the peak prior to ignition in comparison to the thermal ignition preparation period after the peak prior to ignition". This means that "the timing of thermal ignition of the gaseous mixture can be changed with remarkably less energy during the low-temperature oxidation preparation period than during the thermal ignition preparation period". Meanwhile, in order to control the timing of the thermal ignition of the gaseous mixture by merely increasing the amount of OH radicals in the combustion region during the thermal ignition preparation period, the OH radicals are required to be increased by an amount proportionate to the amount of fuel, and thus, an enormous amount of energy is required. According to the first aspect of the present invention, based on the aforementioned finding by the inventor, the timing of thermal ignition of the gaseous mixture in the combustion region is controlled by increasing the amount of OH radicals in the combustion region during the low-temperature oxidation preparation period.

In accordance with a second aspect of the present invention, in addition to the feature of the first aspect of the present invention, the aforementioned control unit adjusts timing of starting control by the radical amount adjusting unit during the low-temperature oxidation preparation period in accordance with intended timing of thermal ignition of the gaseous mixture.

According to the second aspect of the present invention, the timing of starting control by the radical amount adjusting unit is adjusted during the low-temperature oxidation preparation period in accordance with intended timing of thermal ignition of the gaseous mixture in the combustion region. The inventor of the present invention has found the facts that "the peak prior to ignition occurs immediately after the increase in the OH radicals in the combustion region during the low-temperature oxidation preparation period", and "ignition delay time, by which ignition is delayed from the peak prior to ignition to the ignition, is substantially constant". This leads to the fact that "the timing of thermal ignition can be accelerated in accordance with the time period by which the timing, at which the amount of OH radicals in the combustion region is increased during the low-temperature oxidation preparation period, is accelerated". According to the second aspect of the present invention, based on the aforementioned finding by the inventor, the timing of starting control by the radical amount adjusting unit is adjusted during the low-temperature oxidation preparation period in accordance with intended timing of thermal ignition of the gaseous mixture. Since the timing of starting operation of the radical amount adjusting unit is changed in accordance with the timing of starting control of the radical amount adjusting unit, adjusting the timing of starting control by the radical amount adjusting unit means adjusting the timing of starting operation of the radical amount adjusting unit. The same applies to the fourth aspect of the present invention.

In accordance with a third aspect of the present invention, in addition to the features of the first or second aspect of the present invention, the aforementioned radical amount adjusting unit adjusts an amount of OH radicals to be increased in the combustion region during the low-temperature oxidation preparation period in accordance with intended timing of thermal ignition of the gaseous mixture specified by the control unit.

According to the third aspect of the present invention, the amount of OH radicals to be increased during the low-temperature oxidation preparation period is adjusted in accordance with intended timing of thermal ignition of the gaseous mixture in the combustion region. Here, the inventor of the present invention has found out that "in a case in which the amount of OH radicals is increased during the low-temperature oxidation preparation period, timing at which the peak prior to ignition occurs (hereinafter referred to as "LTO timing") is accelerated in accordance with the increased amount of OH radicals". This means that the inventor of the present invention has found the fact that "time period from the timing at which the amount of OH radicals increases up to the LTO timing is reduced as the amount of OH radicals increases". According to the third aspect of the present invention, based on this finding, the amount of OH radicals to be increased in the combustion region during the low-temperature oxidation preparation period is adjusted in accordance with intended timing of thermal ignition of the gaseous mixture.

In accordance with a fourth aspect of the present invention, in addition to the feature of the second aspect of the present invention, while the control unit controls the timing of thermal ignition of the gaseous mixture in a combustion chamber of an internal combustion engine, the control unit estimates timing at which the peak of the heat release rate occurs before the thermal ignition of the gaseous mixture based on an operating status of the internal combustion engine, and determines timing of starting control by the radical amount adjusting unit on the basis of the timing thus estimated.

According to the fourth aspect of the present invention, the LTO timing is estimated based on the operating status of the internal combustion engine. Then, the timing of starting control by the radical amount adjusting unit is determined on the basis of the LTO timing thus estimated.

In accordance with a fifth aspect of the present invention, in addition to the features of any one of first to fourth aspects of the present invention, the control unit controls the radical amount adjusting unit to increase the amount of OH radicals in the combustion region only in a case in which the peak of the heat release rate occurs before the thermal ignition of the gaseous mixture.

According to the fifth aspect of the present invention, the radical amount adjusting unit increases the amount of OH radicals in the combustion region only in a case in which the peak of the heat release rate occurs before the thermal ignition of the gaseous mixture. The inventor of the present invention has found that "if the peak prior to ignition does not occur (if the initial temperature is higher than the LTO end temperature), timing of thermal ignition of gaseous mixture remains almost unchanged unless the amount of OH radicals is increased by an amount almost proportionate to that of fuel". This means that the inventor of the present invention has found the fact that "an enormous amount of energy is required to control the timing of thermal ignition of the gaseous mixture if the peak prior to ignition does not occur". According to the fifth aspect of the present invention, based on this finding, the amount of OH radicals in the combustion region is increased by the radical amount adjusting unit only in a case in which the peak prior to ignition occurs.

In accordance with a sixth aspect of the present invention, in addition to features of anyone of the first to fifth aspects of the present invention, the control unit controls the timing of thermal ignition of gaseous mixture, which has been mixed with hydrocarbon and air in advance, in a combustion chamber of an internal combustion engine, in which the gaseous mixture is compression-ignited.

According to the sixth aspect of the present invention, the ignition control device is provided in the internal combustion engine in which the gaseous mixture, which has been mixed with hydrocarbon and air in advance, is compression-ignited.

In accordance with a seventh aspect of the present invention, in addition to features of any one of the first to sixth aspects of the present invention, the radical amount adjusting unit includes a discharge unit that generates a discharge in the combustion region, and an electric field forming unit that forms an electric field in a discharge area in which the discharge is generated. While the radical amount adjusting unit causes the discharge and the electric field to be reacted with each other to generate plasma, the control unit controls the discharge unit and the electric field forming unit during the low-temperature oxidation preparation period to increase the amount of the OH radicals in the combustion region.

According to the seventh aspect of the present invention, the control unit controls the discharge unit and the electric field forming unit during the low-temperature oxidation preparation period. In the combustion region, relatively large plasma is generated since discharge plasma caused by the discharge absorbs energy of the electric field, and expands. In a plasma forming area, a large amount of OH radicals are generated, and consequently, the amount of OH radicals in the combustion region is increased. According to the seventh aspect of the present invention, OH radicals are generated in a broader area than the plasma forming area in which plasma has been caused only by discharge (plasma forming area before the plasma has expanded).

Effect of the Invention

According to the present invention, since, in a case in which the peak prior to ignition occurs in the combustion region, the timing of thermal ignition of the gaseous mixture can be changed with remarkably less energy during the low-temperature oxidation preparation period than the thermal ignition preparation period, timing of thermal ignition of the gaseous mixture in the combustion region is controlled by increasing the amount of OH radicals in the combustion region during the low-temperature oxidation preparation period. Accordingly, the timing of thermal ignition of the gaseous mixture in the combustion region can be efficiently controlled.

Furthermore, according to the second aspect of the present invention, since the timing of thermal ignition can be accelerated in accordance with the time period by which the timing, at which the amount of OH radicals in the combustion region is increased during the low-temperature oxidation preparation period, is accelerated, timing of starting control by the radical amount adjusting unit is adjusted during the low-temperature oxidation preparation period in accordance with intended timing of thermal ignition of the gaseous mixture. This means that timing of thermal ignition is accelerated by a time period by which the timing of starting control is accelerated. Accordingly, the actual timing of thermal ignition can be appropriately controlled toward the intended timing of thermal ignition of the gaseous mixture.

Furthermore, according to the third aspect of the present invention, since the LTO timing is accelerated in accordance with the increased amount of OH radicals in the combustion region during low-temperature oxidation preparation period, the amount of OH radicals to be increased is adjusted in accordance with intended timing of thermal ignition of the gaseous mixture. Accordingly, the actual timing of thermal ignition can be appropriately controlled toward the intended timing of thermal ignition of the gaseous mixture.

Furthermore, according to the fifth aspect of the present invention, since an enormous amount of energy is required to control the timing of thermal ignition of the gaseous mixture if the peak of the heat release rate does not occur before the gaseous mixture is thermally ignited, the amount of OH radicals in the combustion region is increased by the radical amount adjusting unit only in a case in which the peak of the heat release rate occurs prior to the timing of thermal ignition of the gaseous mixture. Accordingly, it becomes possible to effectively control the timing of thermal ignition of the gaseous mixture in the combustion region.

Furthermore, according to the seventh aspect of the present invention, OH radicals are generated in a broader area than a plasma forming area in which plasma has been caused only by discharge (plasma forming area before the plasma has expanded). Here, the inventor of the present invention has found that "in order to control the timing of thermal ignition of the gaseous mixture by increasing the amount of OH radicals in the combustion region during the low-temperature oxidation preparation period, it is effective to generate OH radicals in a relatively broader area in the combustion region". On the other hand, in a case in which plasma is generated merely by discharge, or laser beam is radiated and condensed to the combustion region (see patent document 1), an area in which OH radicals are generated is narrow. According to the seventh aspect of the present invention, the timing of thermal ignition of the gaseous mixture can be controlled more efficiently in comparison to such cases.

BEST MODE FOR CARRYING OUT THE INVENTION

In the following, a description will be given of the present embodiments of the present invention with reference to drawings. It should be noted that the following embodiments are mere examples that are essentially preferable, and are not intended to limit the scope of the present invention, applied field thereof, or application thereof.

The present embodiment is directed to an ignition control device 30 that controls timing of thermal ignition of an internal combustion engine 20 that compression-ignites gaseous mixture in which, in advance, hydrocarbon has been mixed into air. The ignition control device 30 is merely one example of the present invention. Firstly, the internal combustion engine 20 will be described hereinafter before the ignition control device 30 is described in detail.

<Construction of Internal Combustion Engine>

The internal combustion engine 20 according to the present embodiment is constituted by a piston type internal combustion engine, more specifically, a reciprocating HCCI engine. The method of ignition of the internal combustion engine 20 is the HCCI (Homogeneous Charge Compression Ignition) method. As a fuel for the internal combustion engine 20, a low-octane fuel such as normal heptane is employed. Gasoline may also be employed as the fuel for the internal combustion engine 20.

Figure 1:
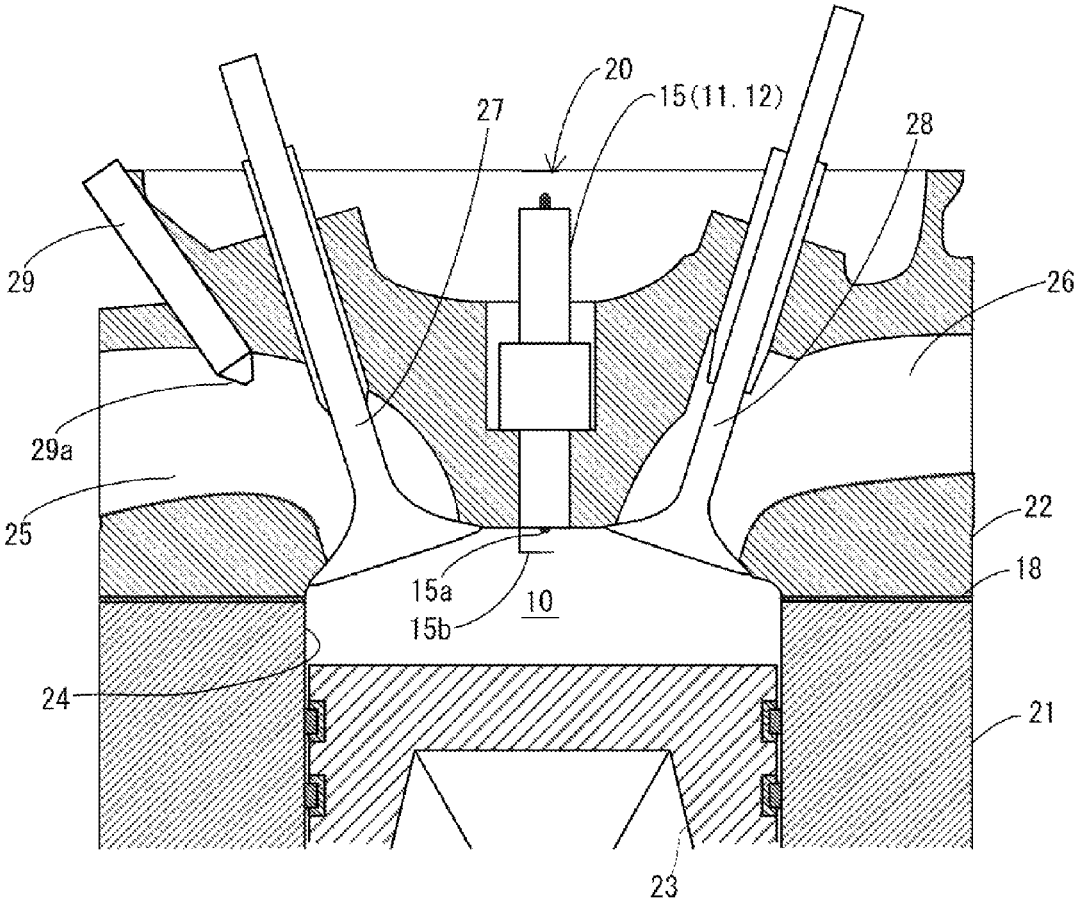
FIG. 1 is a longitudinal cross-section view of an internal combustion engine.

As shown in FIG. 1, the internal combustion engine 20 is provided with a cylinder block 21, a cylinder head 22, and pistons 23. The cylinder block 21 is formed with a plurality of cylinders 24 having circular cross sections. It is to be noted that the number of the cylinders 24 may be one.

Inside of each cylinder 24, the piston 23 is slidably mounted. The piston 23 is connected to a crankshaft (not shown) via a conrod (connecting rod, not shown). The crankshaft is rotatably supported by the cylinder block 21. While the piston 23 reciprocates in each cylinder 24 in an axial direction thereof, the conrod converts the reciprocation of the piston 23 into rotation of the crankshaft.

The cylinder head 22 is placed on the cylinder block 21, and a gasket 18 intervenes between the cylinder block 21 and the cylinder head 22. The cylinder head 22 partitions a combustion chamber 10 along with the cylinder 24 and the piston 23. The cylinder head 24 is formed with one or more intake ports 25 and one or more exhaust ports 26 for each cylinder 24. The intake port 25 is provided with an intake valve 27 for opening and closing the intake port 25, and an injector (fuel injection device) 29 that injects fuel. On the other hand, the exhaust port 26 is provided with an exhaust valve 28 for opening and closing the exhaust port 26.

According to the present embodiment, a nozzle 29*a* of the injector 29 is exposed to the intake port 25, and the fuel injected from the injector 29 is supplied to an air flowing in the intake port 25. To the combustion chamber 10, a gaseous mixture is introduced, in which the fuel has been mixed with the air in advance.

Figure 2:
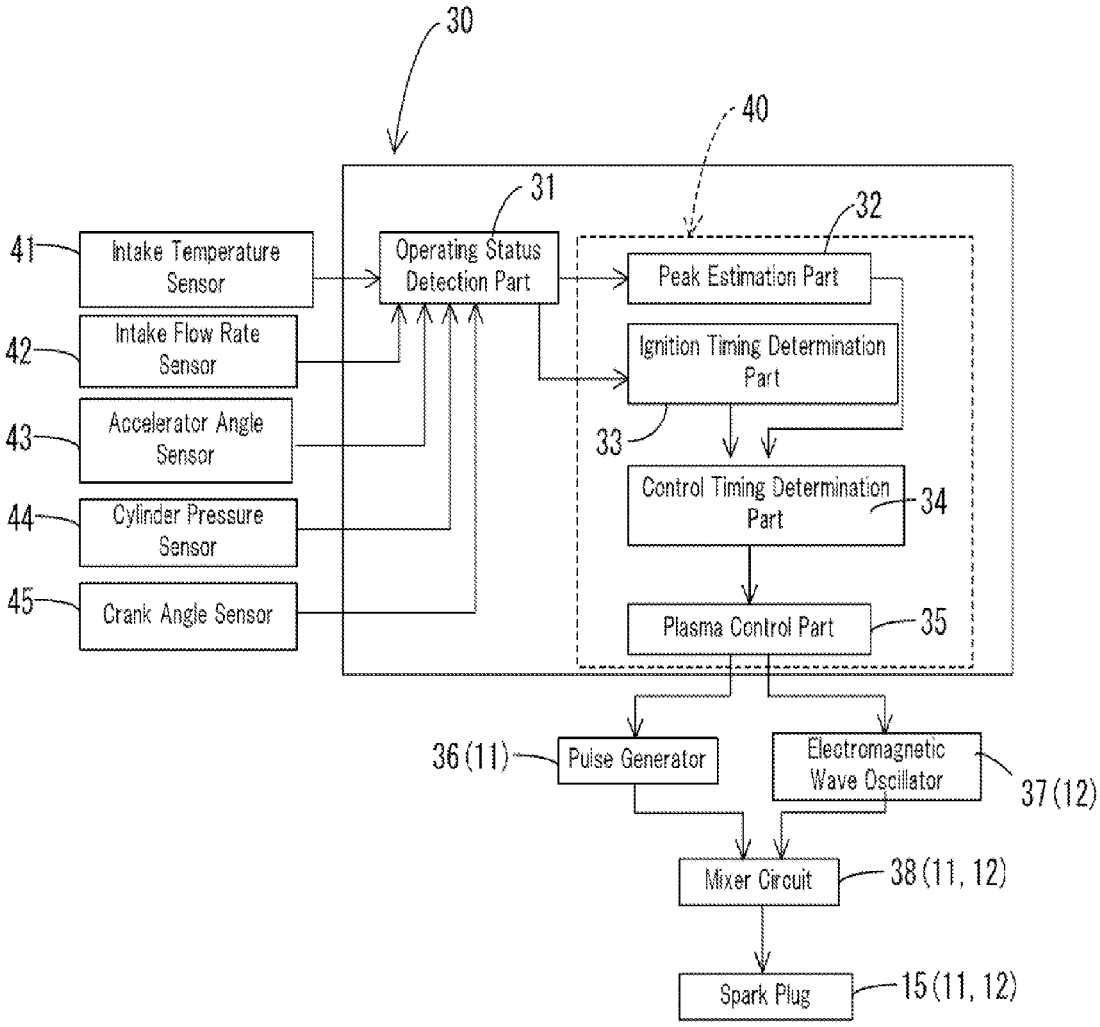
FIG. 2 is a block diagram of an ignition control device.

The cylinder head 22 of each cylinder 24 is provided with one spark plug 15. The spark plug 15 is fixed to the cylinder head 22. As shown in FIG. 2, a center conductor of the spark plug 15 is electrically connected to a pulse generator 36 and an electromagnetic wave oscillator 37 via a mixer circuit 38 that mixes a high voltage pulse and a microwave. To the spark plug 15, the high voltage pulse outputted from the pulse generator 36 and the microwave outputted from the electromagnetic wave oscillator 37 are supplied.

The pulse generator 36 is composed of an ignition coil for automobiles. The electromagnetic wave oscillator 37 is composed of a magnetron (with oscillation frequency of 2.45 GHz). The pulse generator 36 and the electromagnetic wave oscillator 37 are connected to respective power supplies (not shown). Other than the magnetron, an oscillator such as a semiconductor oscillator may be employed as the electromagnetic wave oscillator 37.

According to the configuration described above, when a discharge signal that instructs the pulse generator 36 to output the high voltage pulse is inputted to the pulse generator 36 from the ignition control device 30, the pulse generator 36 outputs the high voltage pulse to the mixer circuit 38. Also, when a radiation signal that instructs the electromagnetic wave oscillator 37 to oscillate the microwave is inputted to the electromagnetic wave oscillator 37 from the ignition control device 30, the electromagnetic wave oscillator 37 outputs the microwave to the mixer circuit 38. The high voltage pulse and the microwave are mixed by the mixer circuit 38 and supplied to the spark plug 15. As a result thereof, in the combustion chamber 10, a spark discharge occurs between a discharge electrode 15*a* and a ground electrode 15*b* of the spark plug 15 to form a small scale plasma. Then, the small scale plasma is irradiated with the microwave from the discharge electrode 15*a* of the spark plug 15. The small scale plasma absorbs energy of the microwave and expands. The discharge electrode 15*a* of the spark plug 15 functions as an antenna for the microwave.

In the combustion chamber 10, a large amount of highly oxidative chemical species such as OH radical and ozone is generated from the moisture in the mixed gas in the expanded plasma forming area. In the present embodiment, the pulse generator 36, the electromagnetic wave oscillator 37, the mixer circuit 38, and the spark plug 15 constitute radical amount adjusting units 11 and 12 that increase the amount of OH radicals in the combustion chamber 10. The radical amount adjusting units 11 and 12 enable a generation of OH radicals in a broader area than the plasma forming area in which plasma has been caused only by discharge (plasma forming area before the plasma has expanded).

The pulse generator 36, the mixer circuit 38, and the spark plug 15 constitute a discharge unit 11 that generates plasma by way of discharge in the combustion chamber 10. The electromagnetic wave oscillator 37, the mixer circuit 38, and the spark plug 15 constitute an electromagnetic wave radiation unit (electric field forming unit) 12 that radiates the electromagnetic wave to the plasma generated by the discharge unit 11. The mixer circuit 38 and the spark plug 15 simultaneously constitute the discharge unit 11 and the electromagnetic wave radiation unit 12.

In the internal combustion engine 20 according to the present embodiment described above, application of the high voltage pulse and radiation of the microwave may take place at different positions in the combustion chamber 10. In this case, an antenna 12 for radiating the microwave is provided apart from the discharge electrode 15*a* of the spark plug 15, and the mixer circuit 38 is not necessary. The pulse generator 36 is directly connected to the spark plug 15, and the electromagnetic wave oscillator 37 is directly connected to the antenna 12. The antenna 12 for the microwave may be integrated with the spark plug 15 in such a manner as that an insulator of the spark plug 15 penetrates therethrough. Also, the antenna 12 may be separated from the spark plug 15.

In the internal combustion engine 20 according to the present embodiment described above, the nozzle 29*a* of the injector 29 may be open to the combustion chamber 10. In this case, for example, during an intake stroke, the nozzle 29*a* of the injector 29 injects fuel into the combustion chamber 10. In the combustion chamber 10, fuel and air are mixed and, as a result thereof, gaseous mixture of fuel and air is generated, in advance, before temperature and pressure of the combustion chamber 10 reach self-ignition conditions.

<Construction of Ignition Control Device>

The ignition control device 30 is composed of, for example, an ECU (Electronic Control Unit) for automobiles. As shown in FIG. 2, the ignition control device 30 is provided with an operating status detection part 31, a peak estimation part 32, an ignition timing determination part 33, a control timing determination part 34, and a plasma control part 35. The peak estimation part 32, the ignition timing determination part 33, the control timing determination part 34, and the plasma control part 35 constitute a control unit 40 that controls the timing of thermal ignition of the gaseous mixture in the combustion chamber 10 by controlling the radical amount adjusting units 11 and 12 so as to increase the amount of OH radicals in the combustion chamber 10 during the low-temperature oxidation preparation period, which will be described later. The control unit 40 adjusts the control timing of the radical amount adjusting units 11 and 12 during the low-temperature oxidation preparation period in accordance with the timing of thermal ignition of the gaseous mixture.

The operating status detection part 31 performs a detection operation of detecting respective values of a plurality of parameters representing the current operating status of the internal combustion engine 20 such as a rotation speed, a load, an accelerator opening angle, an intake air flow rate, and a fuel injection amount of the internal combustion engine 20. During the detection operation, an output signal of an intake temperature sensor 41 that detects temperature of the intake air in the combustion chamber 10, an output signal of an intake flow rate sensor 42 that detects the intake air flow rate, an output signal of an accelerator angle sensor 43 that detects the accelerator opening angle, an output signal of a cylinder pressure sensor 44 that detects an inner pressure of the combustion chamber 10, and an output signal of a crank angle sensor 45 that detects a crank angle are used to detect the rotation speed of the internal combustion engine 20, the load of the internal combustion engine 20, the accelerator opening angle, the intake air flow rate, and the fuel injection amount.

Figure 3:
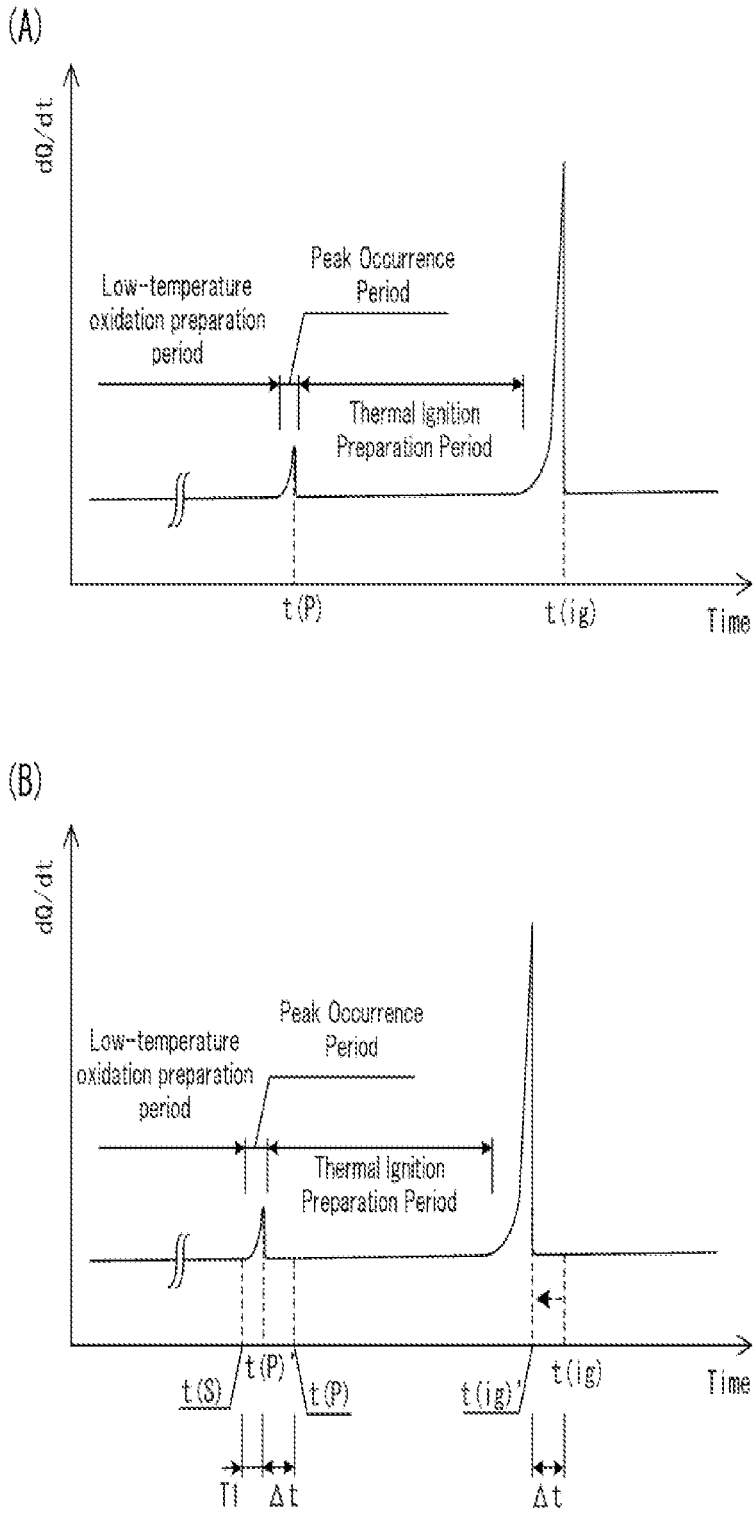
FIG. 3A is a chart showing a change of a heat release rate in a case in which the amount of OH radicals in a combustion chamber is not increased by a radical amount adjusting unit.
FIG. 3B is a chart showing a change of a heat release rate in a case in which the amount of OH radicals in a combustion chamber is increased by the radical amount adjusting unit.

After the detection operation, based on the operating status of the internal combustion engine 20 acquired by the detection operation, the peak estimation part 32 performs an estimation operation of estimating an LTO timing t(P) in a case in which the radical amount adjusting units 11 and 12 do not increase the amount of OH radicals in the combustion chamber 10 (hereinafter, referred to as "LTO timing without increase"). The LTO timing without increase t(P) is shown in FIG. 3A. Also, an LTO timing t(P)' in a case in which the amount of OH radicals is increased in the combustion chamber 10 is shown in FIG. 3B. Hereinafter, "heat release rate" is intended to mean an amount of heat generated per unit time (dQ/dt). However, as for engines, the heat release rate may be regarded as the amount of heat generated divided by a variation of the crank angle.

FIG. 3A is a chart showing the change of the heat release rate in the case in which the radical amount adjusting units 11 and 12 do not increase the amount of OH radicals in the combustion chamber 10. FIG. 3B is a chart showing the change of the heat release rate in the case in which the radical amount adjusting units 11 and 12 increase the amount of OH radicals in the combustion chamber 10.

The peak estimation part 32 is provided with a first control map for acquiring the LTO timing without increase t(P) from the operating status of the internal combustion engine 20. The first control map is configured so as to acquire the LTO timing without increase t(P) from the plurality of parameters such as the rotation speed of the internal combustion engine 20, the load of the internal combustion engine 20, the accelerator opening angle, the intake air flow rate, and the fuel injection amount. This means that the first control map is stored in advance to specify the LTO timing without increase t(P) corresponding to combinations of the plurality of parameters. The peak estimation part 32 performs an estimation operation using the first control map.

After the detection operation, based on the operating status of the internal combustion engine 20 acquired by the detection operation, the ignition timing determination part 33 performs a first determination operation of determining an early ignition time period Δt. Here, the early ignition time period Δt is intended to mean a "time period by which the timing of thermal ignition of the gaseous mixture is accelerated by increasing the amount of OH radicals, in comparison with the ignition timing t(ig) in the case in which the amount of OH radicals is not increased". The intended timing t(ig)' of thermal ignition of the gaseous mixture, at which the gaseous mixture is intended to be thermally ignited, is acquired by subtracting the early ignition time period Δt from the ignition timing t(ig) in the case in which the amount of OH radicals is not increased. The timing t(ig)' changes in accordance with the length of the early ignition time period Δt.

The ignition timing determination part 33 is provided with a second control map for acquiring the early ignition time period Δt from the operating status of the internal combustion engine 20. The second control map is configured so that the early ignition time period Δt can be acquired from the plurality of parameters such as the rotation speed of the internal combustion engine 20 and the load of the internal combustion engine 20, representing the operating status of the internal combustion engine 20. This means that the second control map is stored in advance to specify the early ignition time period Δt corresponding to combinations of the plurality of parameters such as the rotation speed of the internal combustion engine 20 and the load of the internal combustion engine 20. The second control map is configured so as to increase the early ignition time period Δt as the operating range of the internal combustion engine shifts toward lower rotation speed and lower load. The peak estimation part 32 performs the first determination operation using the second control map.

After the estimation operation and the first determination operation, the control timing determination part 34 performs a second determination operation of determining the operation timing of the radical amount adjusting units 11 and 12. As shown in FIG. 3B, the control timing determination part 34 subtracts the early ignition time period Δt, which has been acquired by the first determination operation, and a predetermined first set time period T1 from the LTO timing without increase t(P), which has been acquired by the estimation operation, and determines the resultant value as the operation timing t(S). The operation timing t(S) is determined on the basis of the LTO timing without increase t(P). The first set time period T1 is an estimated value of a time period starting from the operation timing t(S) up to the occurrence of the peak prior to ignition.

In the present embodiment, the timing of starting control t(S) changes within the low-temperature oxidation preparation period in accordance with the length of the early ignition time period Δt. Since the early ignition time period Δt is determined by the intended timing of thermal ignition of the gaseous mixture t(t(ig)−Δt), the timing of starting control t(S) is adjusted in accordance with the intended timing of thermal ignition of the gaseous mixture t(ig)'.

After the second determination operation, based on the timing of starting control t(S) acquired by the second determination operation, the plasma control part 35 performs a plasma generation operation of controlling the radical amount adjusting units 11 and 12.

As the plasma generation operation, the plasma control part 35 outputs a discharge signal to the pulse generator 36 at the timing of starting control t(S), which has been acquired by the second determination operation. A booster coil of the pulse generator 36, upon receiving the discharge signal, starts to accumulate energy inputted from a power supply. When a current flowing through the primary side of the booster coil reaches a predetermined value, a current is induced on the secondary side of the booster coil, and a high voltage pulse is outputted to the spark plug 15. In the present embodiment, the pulse generator 36 is controlled so as to maintain the energy density of the plasma generated by the discharge to be less than the minimum ignition energy.

As the plasma generation operation, the plasma control part 35 outputs a radiation signal to the electromagnetic wave oscillator 37 after a predetermined second set time period T2 has elapsed from the timing of starting control t(S). The electromagnetic wave oscillator 37, upon receiving the radiation signal, starts to radiate the microwave. Here, the second set time period T2 is shorter than the first set time period T1, and shorter than the time period between the points of time when the discharge signal and the high voltage pulse are respectively outputted. As a result thereof, the microwave radiation starts prior to the output of the high voltage pulse. The plasma control part 35 continues the microwave radiation until after the output of the high voltage pulse. The period for each continued microwave radiation exposure is set equal to or lower than a predetermined time period so as to maintain the plasma expanding by the microwave radiation in a state of non-equilibrium plasma, i.e., to prevent the plasma from becoming thermal plasma.

<Operation of Ignition Control Device>

The operation of the ignition control device 30 will be described hereinafter in association with the operation of the internal combustion engine 20.

In each cylinder 24 of the internal combustion engine 20, after the exhaust stroke ends and the piston 23 passes the top dead center, the intake valve 27 is open, and the intake stroke starts. Immediately after the intake stroke starts, the ignition control device 30 outputs an injection signal to the injector 29 to cause the injector 29 to inject fuel. In the combustion chamber 10, the gaseous mixture in which the fuel and air has been mixed in advance flows in. After the piston 23 reaches the bottom dead center, the intake valve 27 is closed, and the intake stroke ends.

After the intake stroke ends, a compression stroke of compressing the gaseous mixture in the combustion chamber 10 starts. As shown in FIG. 3A, the period from when the compression stroke starts until when the gaseous mixture is thermally ignited is divided into the low-temperature oxidation preparation period, a peak occurrence period, and the thermal ignition preparation period. The peak occurrence period is further divided into a low-temperature oxidation period in which the heat release rate increases and an NTC (Negative Temperature Coefficient) period in which the heat release rate decreases.

In the low-temperature oxidation preparation period, in a case in which the amount of OH radicals is increased to accelerate the timing of thermal ignition of the gaseous mixture, i.e., in a case in which the early ignition time period Δt acquired by the second determination operation is larger than zero, the plasma control part 35 outputs the discharge signal to the pulse generator 36 at the timing of starting control t(S) acquired by the estimation operation and, after the second set time period T2 from the timing of starting control t(S), the plasma control part 35 outputs the radiation signal to the electromagnetic wave oscillator 37.

As a result thereof, the high voltage pulse and the microwave are supplied to the discharge electrode 15*a* of the spark plug 15. In the combustion chamber 10, the small scale plasma generated by the spark discharge absorbs the energy of the microwave and expands. In the combustion chamber 10, a large amount of OH radicals are generated from the moisture in the gaseous mixture in the expanded plasma forming area. In the combustion chamber 10, the amount of OH radicals increases during the low-temperature oxidation preparation period.

In the combustion chamber 10, immediately after the amount of OH radicals increases during the low-temperature oxidation preparation period, a transition occurs from the low-temperature oxidation preparation period to the peak occurrence period, and the peak prior to ignition appears. After the heat release rate decreases, a transition occurs from the peak occurrence period to the thermal ignition preparation period.

Figure 4:
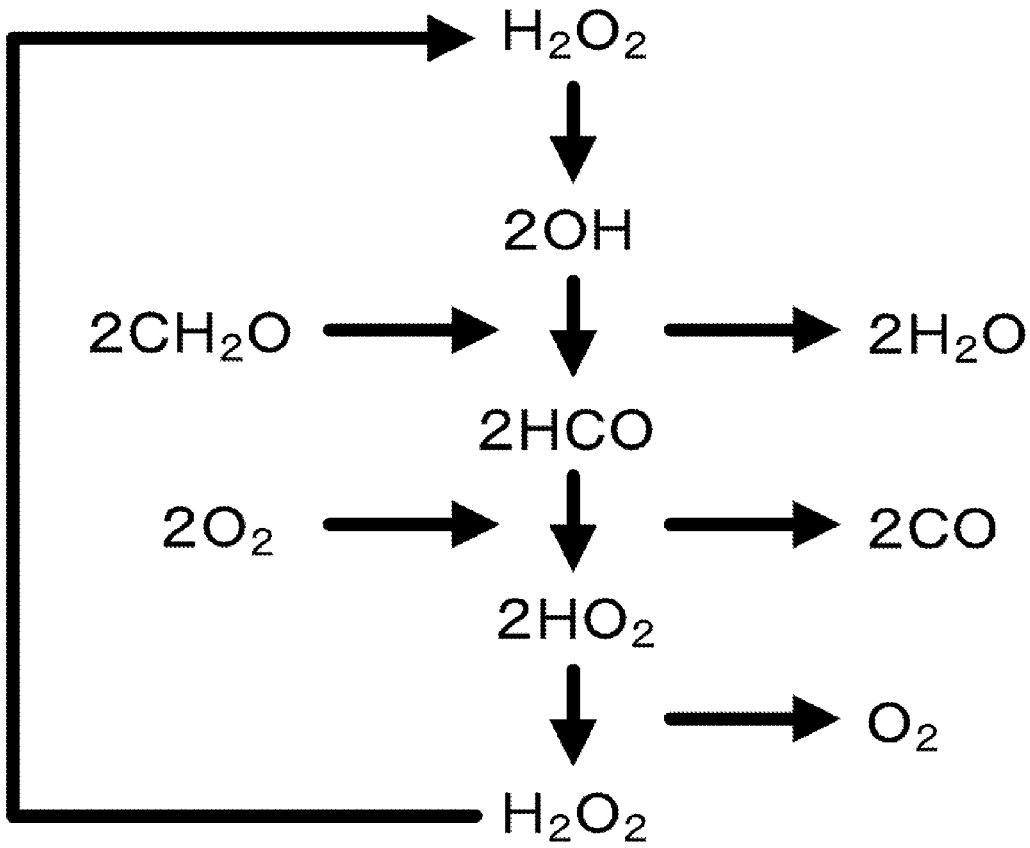
FIG. 4 is a schematic diagram of $H_2O_2$ reaction loop.

During the thermal ignition preparation period, a reaction called as "$H_2O_2$ reaction loop" shown in FIG. 4 takes place predominantly. During the thermal ignition preparation period, the $H_2O_2$ reaction loop generates a large amount of heat without consuming $H_2O_2$, and the gaseous mixture is compressed, thereby achieving temperature conditions required for the thermal ignition. The thermal ignition preparation period (the ignition delay period from the peak prior to ignition to the thermal ignition) is approximately constant in length, regardless of whether or not the amount of OH radicals is increased during the low-temperature oxidation preparation period. Accordingly, the gaseous mixture is thermally ignited (self-ignited) earlier approximately by the early ignition time period $\Delta t$ in comparison to the case in which the timing of thermal ignition is not accelerated by increasing the amount of OH radicals.

The radical amount adjusting units 11 and 12 increase the amount of OH radicals in the combustion chamber 10 during the low-temperature oxidation preparation period within a range such that the thermal ignition preparation period can be started earlier in the combustion chamber 10.

When the gaseous mixture is thermally ignited, the piston 23 is moved toward the bottom dead center by the expansion force of the combustion of the gaseous mixture. Then, before the piston 23 reaches the bottom dead center, the exhaust valve 28 is open, and the exhaust stroke is started. The exhaust valve 28 is closed before the piston 23 reaches the top dead center. As a result thereof, the exhaust stroke ends. In the present embodiment, since the exhaust valve 28 is closed before the piston 23 reaches the top dead center, exhaust gas remains in the combustion chamber.

Effect of Embodiment

In the present embodiment, since, in a case in which the peak prior to ignition occurs in the combustion chamber 10, the energy required during the low-temperature oxidation preparation period to change the timing of thermal ignition of the gaseous mixture is remarkably less in comparison to the energy required during the thermal ignition preparation period, the amount of OH radicals in the combustion chamber 10 is increased during the low-temperature oxidation preparation period, thereby the timing of thermal ignition of the gaseous mixture in the combustion chamber 10 is controlled. Accordingly, it becomes possible to efficiently control the timing of thermal ignition of the gaseous mixture in the combustion chamber 10.

Furthermore, in the present embodiment, since the timing of thermal ignition of the gaseous mixture in the combustion chamber 10 can be efficiently accelerated, large amount of gaseous mixture can be combusted before the gaseous mixture starts to expand. Accordingly, it becomes possible to reduce the amount of unburnt fuel.

Furthermore, in the present embodiment, since the timing of thermal ignition is accelerated in accordance with the time period by which the timing, at which the amount of OH radicals in the combustion chamber 10 is increased, is accelerated, the timing of starting control by the radical amount adjusting units 11 and 12 during the low-temperature oxidation preparation period is adjusted in accordance with the intended timing of thermal ignition of the gaseous mixture. The timing of thermal ignition can be accelerated by a time period by which the timing of starting control by the radical amount adjusting units 11 and 12 is accelerated. Accordingly, it becomes possible to appropriately control the actual timing of thermal ignition toward the intended timing of thermal ignition of the gaseous mixture.

Furthermore, in the present embodiment, since OH radicals are generated in a broader area than the plasma forming area in which plasma has been caused only by discharge (plasma forming area before the plasma has expanded), it becomes possible to effectively control the timing of thermal ignition of the gaseous mixture.

First Modified Example of Embodiment

A first modified example of the present embodiment will be described hereinafter. In the first modified example, the control unit 40 causes the radical amount adjusting units 11 and 12 to adjust the amount of OH radicals to be increased in the combustion chamber 10 during the low-temperature oxidation preparation period in accordance with the intended timing of thermal ignition of the gaseous mixture. In the first modified example, the electromagnetic wave oscillator 37 of the radical amount adjusting units 11 and 12 is controlled so as to increase the increased amount of OH radicals in the combustion chamber 10 in accordance with the degree to which the timing of thermal ignition of the gaseous mixture is accelerated. The electromagnetic wave oscillator 37 is controlled so as to increase the microwave intensity in accordance with the degree to which the timing of thermal ignition of the gaseous mixture is accelerated.

In the first modified example, since, as described above, the LTO timing is accelerated as the increased amount of OH radicals in the combustion chamber 10 during the low-temperature oxidation preparation period is increased, the increased amount of OH radicals is adjusted in accordance with the timing of thermal ignition of the gaseous mixture. Accordingly, it becomes possible to appropriately control the actual timing of thermal ignition toward the intended timing of thermal ignition of the gaseous mixture.

Second Modified Example of Embodiment

A second modified example of the present embodiment will be described hereinafter. In the second modified example, the control unit 40 causes the radical amount adjusting units 11 and 12 to increase the amount of OH radicals in the combustion chamber 10 only in a case in which the peak prior to ignition occurs. Prior to the estimation operation, the peak estimation part 32 of the control unit 40 performs a determination operation of determining whether or not the peak prior to ignition occurs based on the present operating status of the internal combustion engine 20. The peak estimation part 32 performs the estimation operation only when it has been determined in the determination operation that the peak prior to ignition will occur. If it has been determined in the determination operation that the peak prior to ignition will not occur, the plasma control part 35 does not output the discharge signal nor the radiation signal.

Other Embodiments

The above described embodiment may be configured as follows.

In the present embodiment described above, a spray device that sprays water to the intake port 25 may be provided to increase the moisture included in the gaseous mixture so that the amount of OH radicals generated by the plasma may increase.

Furthermore, in the present embodiment described above, the radical amount adjusting units 11 and 12 may be configured so as to generate OH radicals utilizing photocatalyst and a light source, or utilizing silent discharge or creeping discharge.

Furthermore, in the present embodiment described above, the radical amount adjusting units 11 and 12 may be configured so as to increase the amount of OH radicals in the combustion chamber 10 by introducing OH radicals generated outside of the combustion chamber 10 into the combustion chamber 10.

Furthermore, in the present embodiment described above, an alternating voltage generating device that outputs high alternating voltage may be employed in place of the electromagnetic wave oscillator 37. The alternating voltage generating device supplies an alternating voltage to the discharge electrode 15*a* of the spark plug 15 at the same time as the pulse generator 36 outputs the high voltage pulse, thereby forming an electric field in the vicinity of the tip of the discharge electrode 15*a*. The discharge plasma generated by the high voltage pulse reacts with the electric field and expands to a relatively large volume.

INDUSTRIAL APPLICABILITY

The present invention is useful in relation to an ignition control device that controls a timing of thermal ignition of gaseous mixture of hydrocarbon and air.

EXPLANATION OF REFERENCE NUMERALS

10 Combustion chamber (combustion region)
11 Discharge unit (radical amount adjusting unit)
12 Electromagnetic wave radiation unit (radical amount adjusting unit)
15 Spark plug (discharge unit, electric field forming unit)
20 Internal combustion engine
30 Ignition control device
31 Operating status detection part
32 Peak estimation part (control unit)
33 Ignition timing determination part (control unit)
34 Control timing determination part (control unit)
35 Plasma control part (control unit)
36 Pulse generator (discharge unit)
37 Electromagnetic wave oscillator (electric field forming unit)
40 Control unit

The invention claimed is:

1. An ignition control device, comprising: a control unit that controls a radical amount adjusting unit that increases an amount of OH radicals in a combustion region in which gaseous mixture of hydrocarbon and air is combusted, wherein the control unit controls timing of thermal ignition of the gaseous mixture in the combustion region by controlling the radical amount adjusting unit so as to increase the amount of OH radicals in the combustion region during a low-temperature oxidation preparation period that occurs prior to a peak of a heat release rate before the thermal ignition of the gaseous mixture.

2. The ignition control device as set forth in claim 1, wherein the control unit adjusts timing of starting control by the radical amount adjusting unit during the low-temperature oxidation preparation period in accordance with intended timing of thermal ignition of the gaseous mixture.

3. The ignition control device as set forth in claim 1 or claim 2, wherein the control unit adjusts an amount of OH radicals to be increased in the combustion region during the low-temperature oxidation preparation period by the radical amount adjusting unit, in accordance with intended timing of thermal ignition of the gaseous mixture.

4. The ignition control device as set forth in claim 2, wherein while the control unit controls the timing of thermal ignition of the gaseous mixture in a combustion chamber of an internal combustion engine, the control unit estimates timing at which the peak of the heat release rate occurs before the thermal ignition of the gaseous mixture based on an operating status of the internal combustion engine, and determines timing of starting control by the radical amount adjusting unit on the basis of the timing thus estimated.

5. The ignition control device as set forth in claim 1, wherein the control unit increases the amount of OH radicals in the combustion region by the radical amount adjusting unit, only in a case in which the peak of the heat release rate occurs before the thermal ignition of the gaseous mixture.

6. The ignition control device as set forth in claim 1, wherein the control unit controls the timing of thermal ignition of gaseous mixture, which has been mixed with hydrocarbon and air in advance, in a combustion chamber of an internal combustion engine, in which the gaseous mixture is compression-ignited.

7. The ignition control device as set forth in claim 1, wherein the radical amount adjusting unit includes a discharge unit that generates a discharge in the combustion region, and an electric field forming unit that forms an electric field in a discharge area in which the discharge is generated, while the radical amount adjusting unit causes the discharge and the electric field to be reacted with each other to generate plasma, the control unit controls the discharge unit and the electric field forming unit during the low-temperature oxidation preparation period to increase the amount of the OH radicals in the combustion region.

* * * * *